US010219602B2

(12) United States Patent
Purkey et al.

(10) Patent No.: US 10,219,602 B2
(45) **Date of Patent: *Mar. 5, 2019**

(54) HAIR LIFTING, RETENTION, AND STYLING DEVICE INCLUDING ACCESSORIES

(71) Applicant: Purkey Enterprises, LLC, Gainesville, FL (US)

(72) Inventors: Janet L. Purkey, Knoxville, TN (US); Laura Barker, Knoxville, TN (US); Judy Roark, Knoxville, TN (US)

(73) Assignee: Purkey Enterprises, LLC, Gainesville, FL (US)

( * ) Notice: Subject to any disclaimer, the term of this patent is extended or adjusted under 35 U.S.C. 154(b) by 563 days.

This patent is subject to a terminal disclaimer.

(21) Appl. No.: 14/847,293

(22) Filed: Sep. 8, 2015

(65) Prior Publication Data

US 2016/0058152 A1 Mar. 3, 2016

Related U.S. Application Data

(63) Continuation-in-part of application No. 14/476,105, filed on Sep. 3, 2014, now Pat. No. 9,427,059.

(60) Provisional application No. 62/046,361, filed on Sep. 5, 2014.

(51) Int. Cl.

| | |
|---|---|
| ***A45D 8/00*** | (2006.01) |
| ***A45D 8/38*** | (2006.01) |
| ***A45D 8/36*** | (2006.01) |

(52) U.S. Cl.

CPC ..... *A45D 8/38* (2013.01); *A45D 8/36* (2013.01)

(58) Field of Classification Search

CPC ... A45D 8/06; A45D 8/10; A45D 8/34; A45D 8/36; A45D 8/38

See application file for complete search history.

(56) References Cited

U.S. PATENT DOCUMENTS

| | | | |
|---|---|---|---|
| D7,524 | S | 6/1874 | Mullee |
| 1,558,931 | A | 10/1925 | Senegas |
| 2,868,214 | A | 1/1959 | Levy |
| 3,031,681 | A | 5/1962 | Hoeflich |
| D194,556 | S | 2/1963 | Ranck |
| 3,471,867 | A | 10/1969 | Kirchhoff |
| 4,597,469 | A | 7/1986 | Nagashima |
| 5,175,887 | A | 1/1993 | Kim |
| 5,692,243 | A | 12/1997 | Chang |
| 5,697,386 | A | 12/1997 | Chang |

(Continued)

*Primary Examiner* — Rachel R Steitz

(74) *Attorney, Agent, or Firm* — Pitts & Lake, P.C.

(57) ABSTRACT

A hair lifting, retention, and styling device having a substantially rectilinear cross piece member having a first distal end and a second distal end and first and second substantially rectilinear side members cooperating with the substantially rectilinear cross piece member, wherein said first and second substantially rectilinear side members are disposed proximate said first and second distal ends of the cross piece member. Further, curved bight members are disposed between the cross piece member and the side members, such that the curvilinear design and the bight members co-act to provide lift and enhanced volume to a wearer's hair style thus augmenting and enhancing the wearer's chosen hairstyle. In an alternate embodiment, the rectilinear side members include at least one telescoping section such that the length of the side members is adjustable.

18 Claims, 15 Drawing Sheets

(56) References Cited

U.S. PATENT DOCUMENTS

| | | | | |
|---|---|---|---|---|
| 5,987,647 | A | 11/1999 | Ouellette | |
| 6,421,837 | B1 | 7/2002 | Pearcy | |
| D461,932 | S | 8/2002 | Riva | |
| D494,711 | S | 8/2004 | LeBow | |
| 6,993,143 | B2 | 1/2006 | Harris et al. | |
| 7,156,106 | B2 | 1/2007 | Lawson | |
| 7,455,402 | B2 | 11/2008 | Gerber et al. | |
| D638,993 | S | 5/2011 | Goodwin | |
| 8,360,077 | B2 | 1/2013 | Defenbaugh et al. | |
| 8,422,718 | B2 | 4/2013 | Santiago | |
| 2005/0081280 | A1 | 4/2005 | Allgood | |
| 2006/0144416 | A1* | 7/2006 | Neal | A45D 8/36 132/275 |
| 2008/0283082 | A1 | 11/2008 | Jagemann | |
| 2009/0032050 | A1* | 2/2009 | Defenbaugh | A45D 8/36 132/273 |
| 2010/0177907 | A1 | 7/2010 | Morisawa | |

* cited by examiner

HAIR LIFTING, RETENTION, AND STYLING DEVICE INCLUDING ACCESSORIES

CROSS-REFERENCE TO RELATED APPLICATIONS

This application claims the benefit of U.S. Provisional Patent Application No. 62/046,361, filed on Sep. 5, 2014, and U.S. Non-Provisional patent application Ser. No. 14/476,105 filed Sep. 3, 2014, both of which are incorporated herein in their entirety by reference.

STATEMENT REGARDING FEDERALLY SPONSORED RESEARCH OR DEVELOPMENT

Not Applicable

BACKGROUND OF THE INVENTION

1. Field of Invention

This invention pertains to a women's hair accessory; more specifically, the invention pertains to a hair lifting, retention, and styling device for providing enhanced volume to a wearer's hairstyle. More particularly, this invention pertains to a head-worn device that lifts the hair for the purpose of adding heightened, or enhanced, volume and shape to the wearer's hairstyle while simultaneously retaining a wearer's hair from in front of the wearer's face. Additionally, according to one embodiment of the present invention, the hair lifting, retention, and styling device is provided with cooperating hinges that allow the device to be folded for storing the device in a pocket or case when the device is not being worn.

2. Description of the Related Art

Curvilinear, or substantially curvilinear hair bands, sometimes referred to as headbands, have been long known in the art for keeping long hair out of the wearer's eyes and from in front of the wearer's face. The headband devices known and described in the art typically press, or pull, the hair tightly and press the hair flat against the wearer's head. Typical of these devices are the devices taught and described in the following U.S. patents. U.S. Pat. No. 2,868,214, issued to J. M. Levy on Jan. 13, 1959, teaches and discloses a hair band with means for gripping the hair so as to substantially prevent slippage of the hair band. U.S. Pat. No. 3,031,681, issued to V. T. Hoeflich on May 1, 1962, discloses a tiara-like head-worn device as a novelty for parties. U.S. Pat. No. 3,471,867 issued to B. J. Kirchoff on Oct. 14, 1969, discloses a scarf-like device incorporating a flexible coil-type rib. U.S. Pat. No. 5,175,887 issued to Daniel S. Y. Kim on Jan. 5, 1993, discloses an absorbent headband having a resilient inner frame member. U.S. Pat. No. 5,692,243 issued to Wen Shyong Chang on Dec. 2, 1997, discloses a hair band having a main body and two retaining pieces releasably attached to the main body. U.S. Pat. No. 5,697,386 issued to Wen-Shyong Chang on Dec. 16, 1997 similarly discloses a hair band having releasably attached end members. U.S. Pat. No. 5,937,872 issued to Hsien Chu Wang on Aug. 17, 1999, discloses a foldable hair holder that is substantially curvilinear or arcuate. U.S. Pat. No. 5,987,647 issued to Jennifer Ouellette on Nov. 23, 1999, discloses an arcuate, or curvilinear, woman's headband and a method for its construction. U.S. Pat. No. 7,156,106 issued to Deborah Lawson on Jan. 2, 2007, discloses a foldable decorative hair band having an outwardly bowed bridging strip section that is adapted to receive a detachable decorative plate. Finally, U.S. Pat. No. 8,360,077 issued to Michael Defenbaugh et al. on Jan. 29, 2013, discloses a substantially curvilinear headband having pliable ends.

The known devices as described above are substantially curvilinear, or arcuate, which leads to them sharing the common trait that they are designed to pull the wearer's hair tightly and flatly against the wearer's head. What is missing from the known art is a substantially rectilinear hair lifting, retention, and styling device for adding volume, or enhanced shape, to the wearer's hairstyle and optimizing comfort.

BRIEF SUMMARY OF THE INVENTION

According to one embodiment of the present invention, a substantially rectilinear hair lifting, retention, and styling device is provided. The substantially rectilinear hair lifting, retention, and styling device, rather than pulling the wearer's hair flatly against the wearer's head, lifts the wearer's hair providing volume and enhanced shape to the wearer's hairstyle. While in one embodiment the main body, or cross piece of the hair lifting, retention, and styling device and its first and second side piece members could be of unitary design, in the preferred embodiment the first and second side piece members are attached to the cross piece member of the hair lifting, retention, and styling device by means of hinge members thereby allowing the hair lifting, retention, and styling device to be folded compactly when not in use thereby allowing for ease of storing the hair lifting, retention, and styling device in a user's pocket or case. Further, in one embodiment, the side piece members are telescoping to further facilitate storage when the hair lifting, retention, and styling device is not in use. It will be appreciated that the telescoping side arms also allow the wearer to adjust the size of the device for optimal fit and comfort. Additionally, in an alternate embodiment, a hinge member is disposed proximate the midsection of the cross piece member allowing the device to collapse in on itself.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 4:
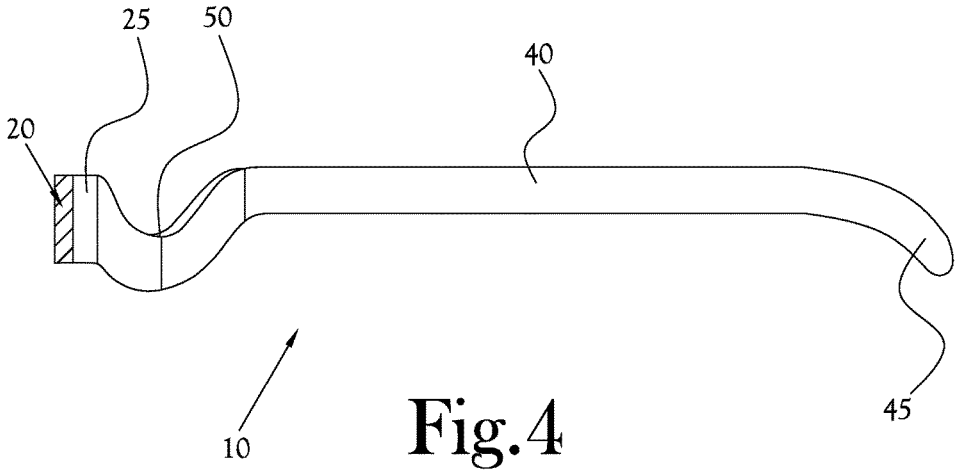
FIG. 4 is a top plan view of the hair lifting, retention, and styling device illustrated in FIG. 1.

A hair lifting, retention, and styling device 10 is disclosed. As compared to prior art head bands that are designed and intended to press the wearer's hair tightly and flatly against the wearer's head, the hair lifting, retention, and styling device 10 of the present invention is designed to add lift and volume to the wearer's hairstyle while simultaneously retaining the wearer's hair away from the wearer's face. As can be seen in FIG. 4, the hair lifting, retention, and styling device 10 has an elongated, substantially rectilinear cross piece member 20 having first and second distal ends 25. The term "substantially rectilinear", as used herein, includes a range from strictly straight, such that it defines a plane, to having a very slight arc such that the distal ends 25 of the cross piece member 20 do not deviate more than 0.20 inches, or more than approximately five percent of the length of cross piece member 20, from a line tangential with a midpoint of the cross piece member 20. The hair lifting, retention, and styling device 10 also includes elongated side members 40 carried proximate the cross piece member 20. Side members 40 terminate in distal end members 45. While distal end members 45 can be substantially co-linear with side members 40, in the preferred embodiment, distal end members 45 are angled slightly toward the wearer's head, as illustrated most clearly in FIGS. 1 and 4, thereby substantially reducing, if not altogether eliminating, headache-inducing pressure points against the wearer's skull as is commonly experienced with prior art head bands.

Figure 1:
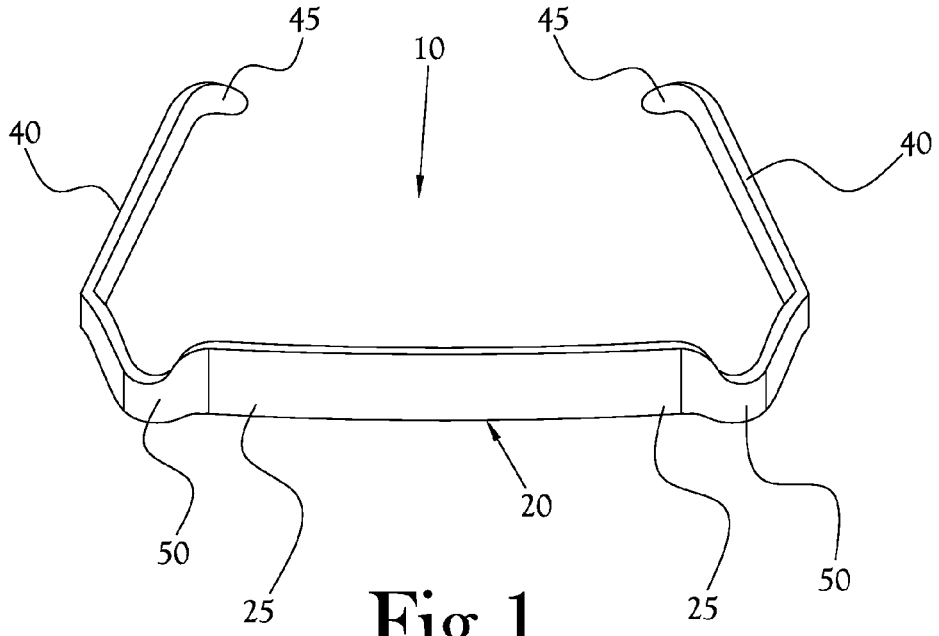
FIG. 1 is a perspective view of one embodiment of the hair lifting, retention, and styling device of the present invention.
Figure 2:
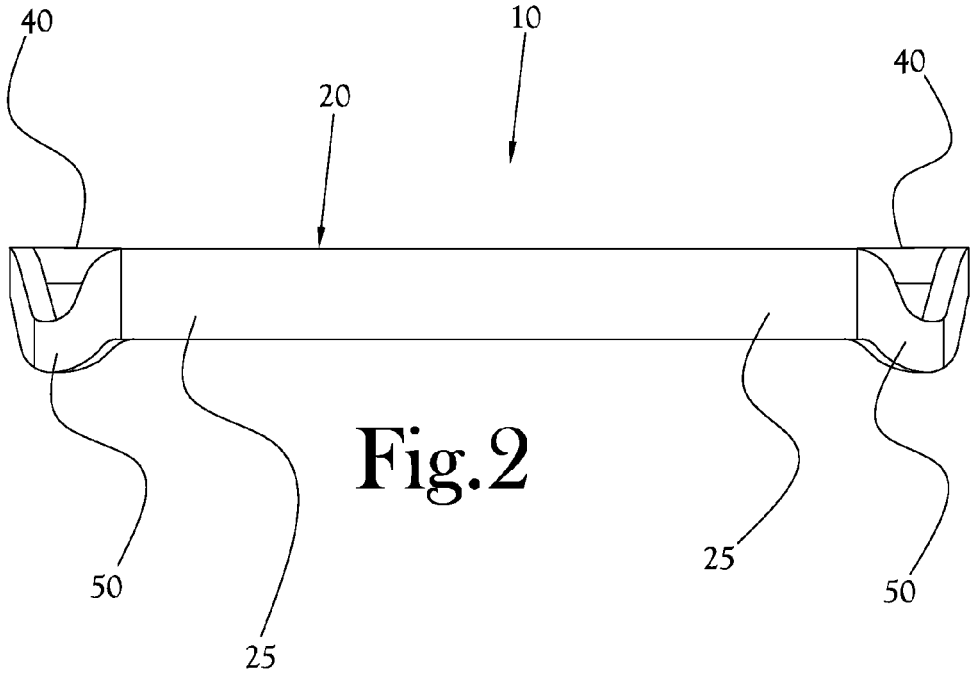
FIG. 2 is a front elevation view of the hair lifting, retention, and styling device illustrated in FIG. 1.
Figure 3:
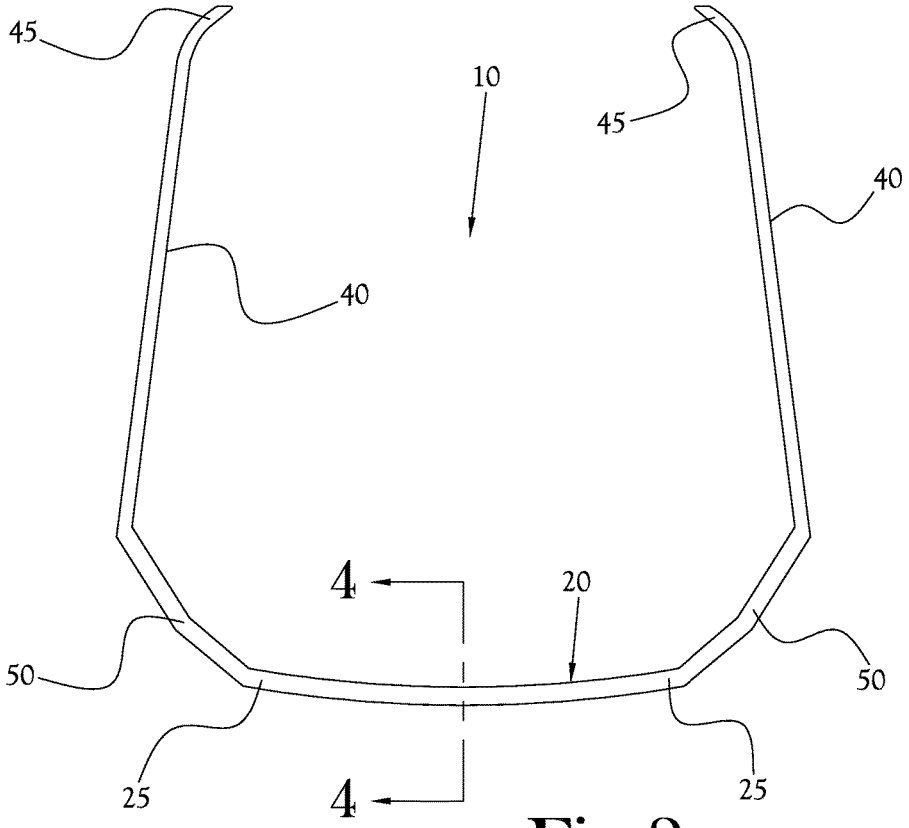
FIG. 3 is a side elevation view, in partial cross-section taken at cut line 2 in FIG. 3, of the hair lifting, retention, and styling device illustrated in FIG. 1.

As seen in FIGS. 1-4, angled side sections having, preferably, vertically oriented curved portions defining bight members 50 are disposed between side members 40 and the distal ends 25 of rectilinear cross piece member 20 thereby serving as a bridge between cross piece member 20 and the cooperating side members 40. One purpose of disposing bight member 50 between cross piece member 20 and the cooperating side members 40 is to selectively offset the cross piece member 20 from the cooperating side members 40 thereby reducing the "pointed" or squared off appearance of hair lifting, retention, and styling device 10 which, in turn can make the hair lifting, retention, and styling device 10 less conspicuous. Further, the relative angle of the bight members 50 with the cooperating cross piece member 20 and side members 40 can be selected based on the degree of preferred offset. Further, the curvature of the bight member 50 enhances the hair lifting and volume enhancing function of hair lifting, retention and styling device 10. As seen in FIGS. 1-3, the cross piece member 20 and the side members 40 have a substantially rectangular cross-section and the curvature of the bight members 50 is adapted to be pointed downward, see FIG. 3.

Figure 5:
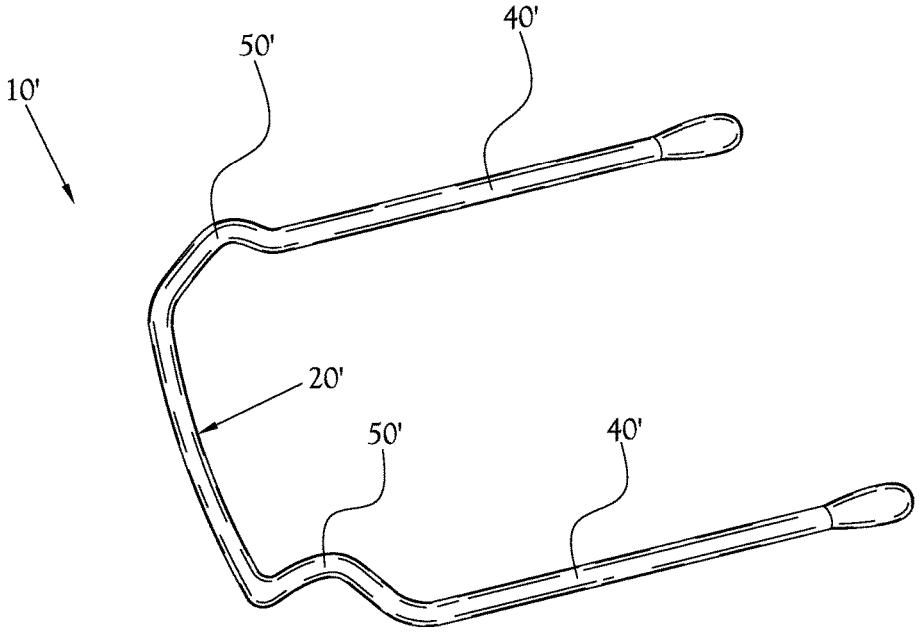
FIG. 5 is a perspective view of an alternate embodiment of the hair lifting, retention, and styling device of the present invention.
Figure 6:
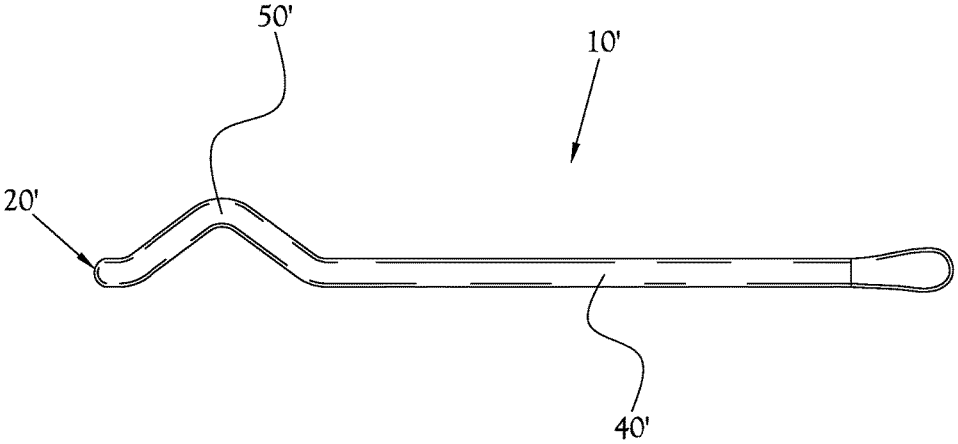
FIG. 6 is a front elevation view of the hair lifting, retention, and styling device illustrated in FIG. 4.
Figure 7:
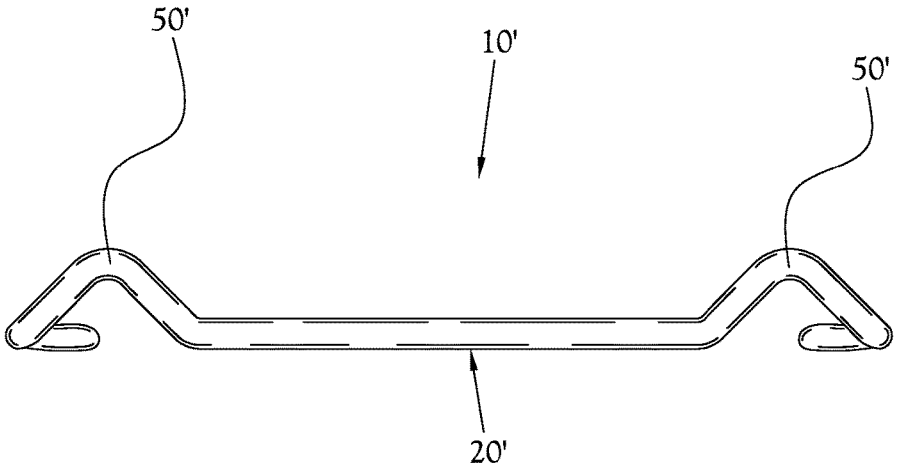
FIG. 7 is a side elevation view, in partial cross-section taken at cut line 7 in FIG. 6, of the hair lifting, retention, and styling device illustrated in FIG. 4.
Figure 8:
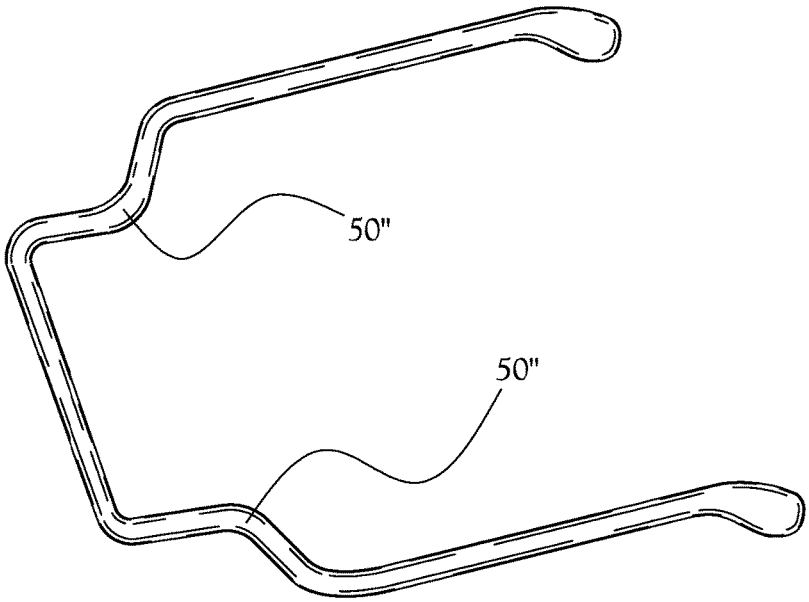
FIG. 8 is a perspective view of yet another alternate embodiment of the hair lifting, retention, and styling device of the present invention.

In an alternate embodiment of hair lifting, retention, and styling device 10', illustrated in FIGS. 5-7, the cross piece member 20' and elongated side members 40' have a substantially cylindrical cross-section. Further, the curved portion of bight members 50' are adapted to point upward, see FIG. 7. As seen in the Figures, the bight members, 50 or 50', have a first portion that curves downwardly from substantially rectilinear cross piece member 20 and a second section that curves upwardly towards the respective substantially rectilinear side piece member 40. It will be appreciated that the terms "downwardly" and "upwardly" are relative terms depending on the orientation of the hair lifting, retention, and styling device of the present invention. It will be recognized that with respect to each of the various embodiments described herein, the present invention is not limited to the specific dimensions and radii of the bight members or the angles disposed between the bight members, and the cross piece member. In another embodiment, illustrated in FIG. 8, rather than curving downward or upward as described above, the bight members 50" curve inward. The bight members, in either embodiment, i.e. 50. 50', or 50", enhance the lift and natural flow of the wearer's hair, in the style to be maintained, unlike prior art "headbands" which compress the hair against the wearer's head inhibiting the hair's natural flow.

Figure 9A:
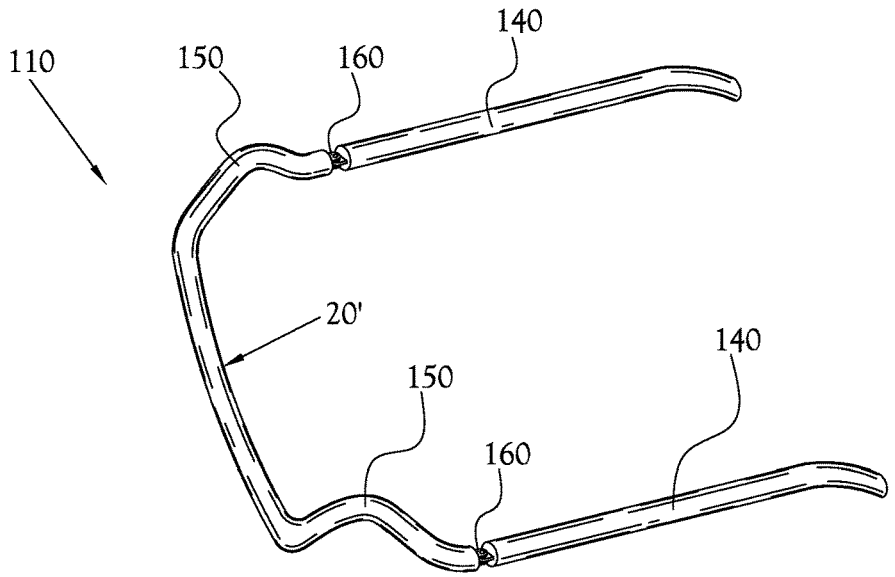
FIGS. 9A and 9B are perspective views of an alternate embodiment of the hair lifting, retention, and styling device illustrated in FIG. 1 having hinged side members.
Figure 9B:
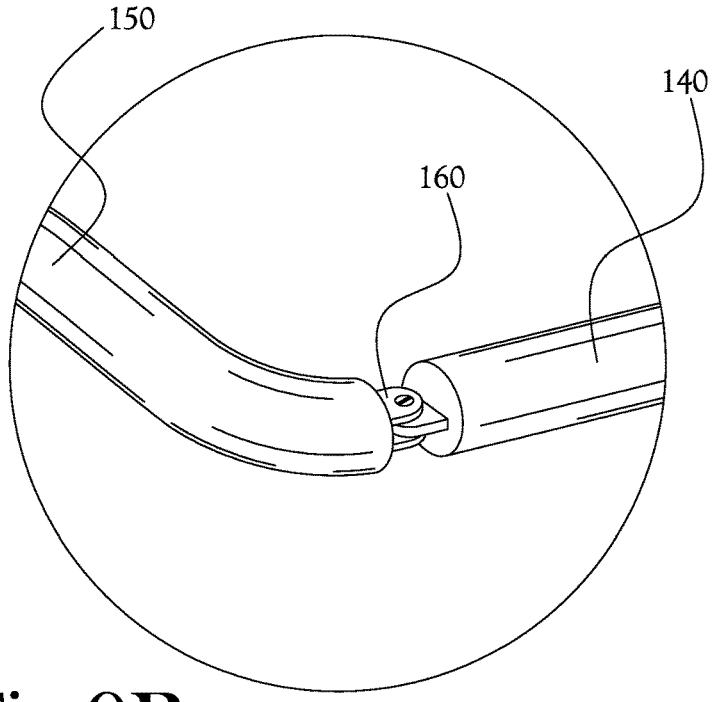

In still another alternate embodiment, illustrated in FIGS. 9A and 9B, in order to facilitate greater ease of storing and carrying the hair lifting, retention, and styling device of the present invention when it is not being worn, hair lifting, retention, and styling device 110, in FIGS. 9A and 9B, includes side members 140 which are hingedly connected with the bight members 150 by hinge members 160 such that the side members 140 can be folded inwardly when not being worn, thus allowing the hair lifting, retention, and styling device 110 to be folded and easily stowed in a pocket or a case when the hair lifting, retention, and styling device 110 is not in use.

Those skilled in the art will recognize that the hair lifting, retention, and styling devices described herein, i.e. preferred embodiment 10, alternate embodiment 10', and alternate embodiment 110 can be utilized as styling devices. In this regard, if the hair lifting, retention, and styling device 10, and the other embodiments, is positioned on the wearer's head while the wearer's hair is wet, the lifting and volume enhancing effect will last longer as it will "set", as will be understood by those skilled in the art, as the wearer's hair dries. This effect can be still further prolonged by the application of various hair products, such as hair sprays, mousses, and gels. The hair lifting, retention, and styling device 10, and the other disclosed embodiments, provide the taught lift and volume enhancement to substantially all types of hair and to hair of various lengths.

Figure 10:
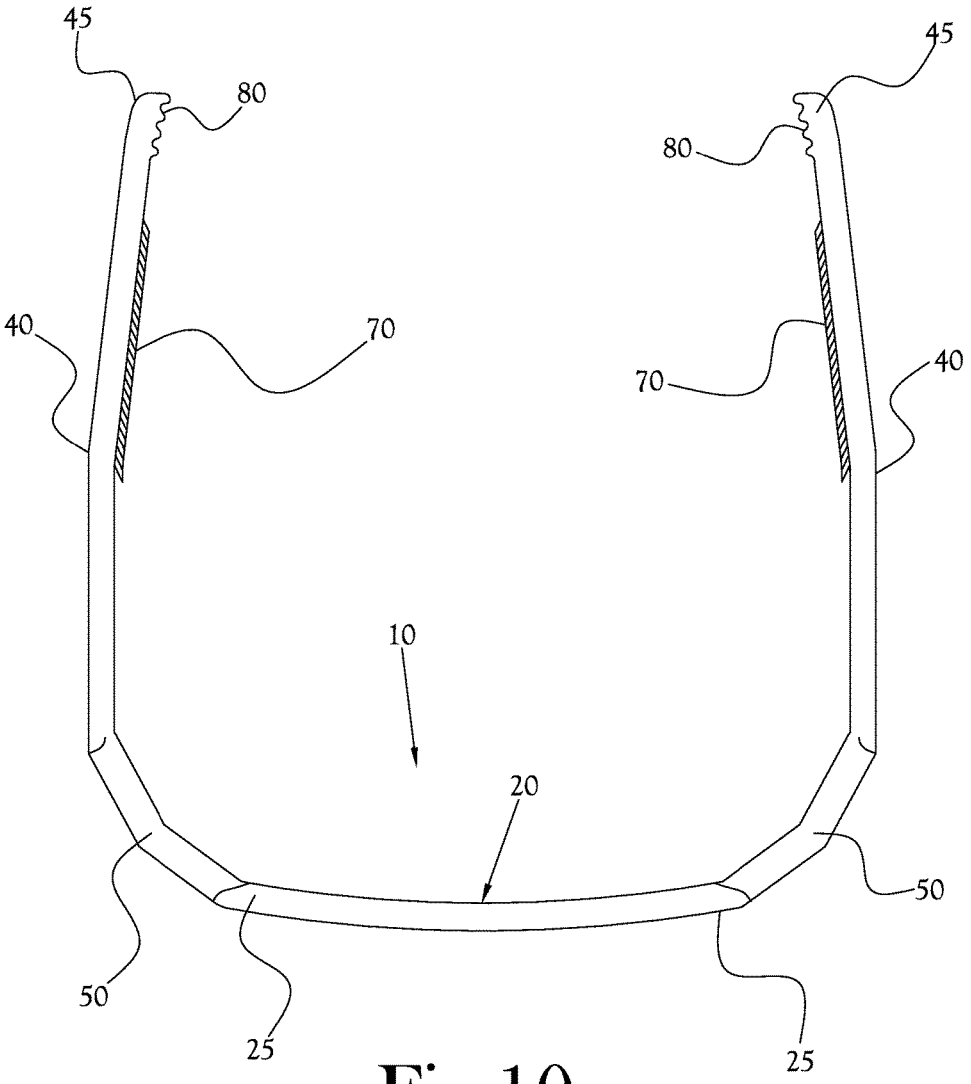
FIG. 10 is a top plan view of still a further embodiment of the hair lifting, retention, and styling device of the present invention.

It will be further recognized by those skilled in the art that in either the preferred embodiment hair lifting, retention, and styling device 10, or the other embodiments described herein, the interior surface of the portions of the cross piece member 20 and the side members 40 can be smooth or, as illustrated in FIG. 10, can have grooved portions 70 that are grooved, and the distal ends 45 of side members 40 can include serrations or teeth 80 for providing enhanced gripping of the wearer's hair without departing from the spirit and scope of the present invention.

Additionally, in the further embodiment, in accordance with the present invention and as illustrated in FIGS. 11-14, hair lifting, retention, and styling device 210 includes an elongated, substantially rectilinear cross piece member 220 having first and second distal ends 225. The hair lifting, retention, and styling device 210 also includes elongated side members 240 carried proximate the cross piece member 220. Side members 240 terminate in distal end members 245. Further, as described above, angled side sections having, preferably, vertically oriented curved portions defining bight members 250 are disposed between side members 240 and the distal ends 225 of rectilinear cross piece member 220 thereby serving as a bridge between cross piece member 220 and the cooperating side members 240. The side members 240 have telescoping members 242 and 244, respectively, which extend and retract telescopically from side members 240, such that the length of the side members inclusive of the telescoping members is adjustable thereby allowing the wearer to adjust the size of the device 210 for optimal fit and comfort. Further, the hair lifting, retention, and styling device 210 is foldable. In this regard, as described above, hinge members 260 are provided between bight members 250 and side members 240. Further, rectilinear cross piece member 220 is also provided with a hinge member 265 proximate the midpoint of cross piece member 220. Hinge member 265 allows rectilinear cross piece member 220 to be folded compactly for storage. In one embodiment the axis of rotation for hinge member 265 is orthogonal to the axis of rotation of hinge members 260.

Figure 11:
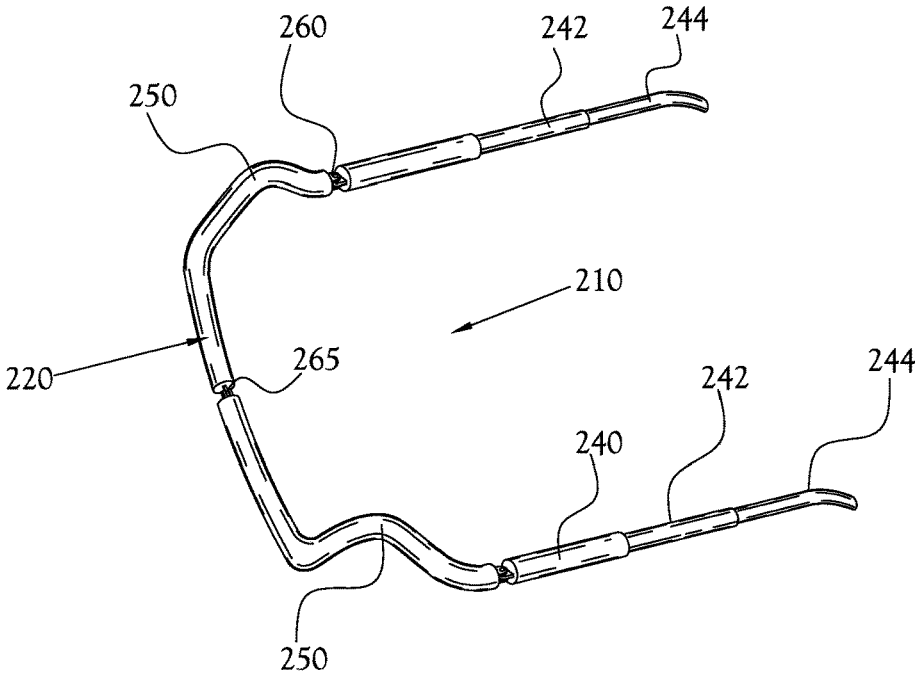
FIG. 11 is a perspective view of yet another alternate embodiment of the hair lifting, retention, and styling device of the present invention incorporating a hinged cross piece member and telescoping side members.
Figure 12:
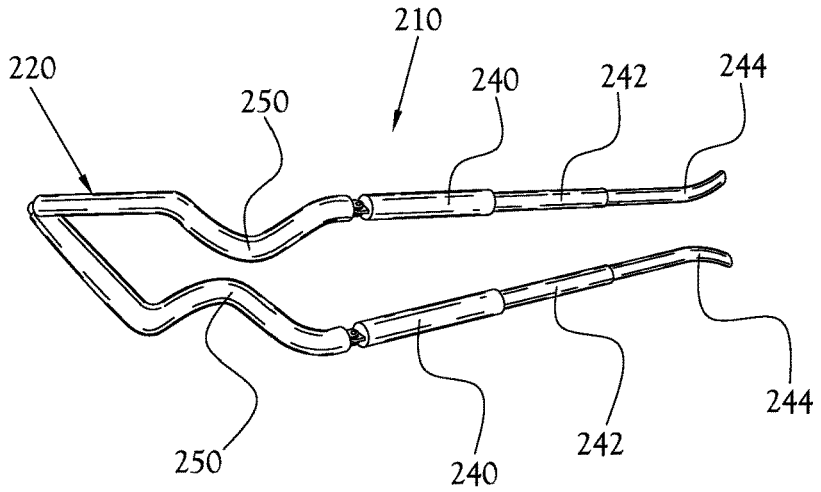
FIG. 12 is a perspective view of the hair retention, lifting, and styling device as illustrated in FIG. 11 in which the cross piece has been folded.
Figure 13:
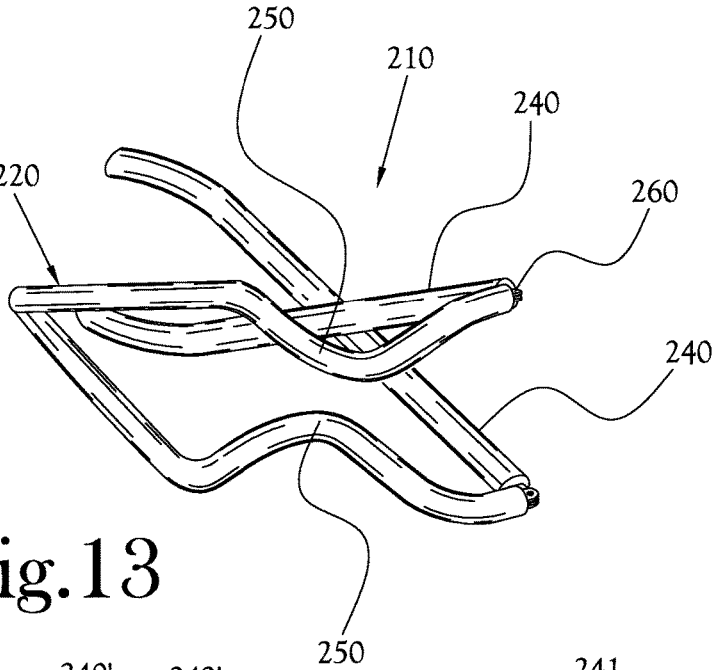
FIG. 13 is a perspective view of the hair retention, lifting, and styling device as illustrated in FIG. 11 in which the cross piece and the side members have been folded.
Figure 14:
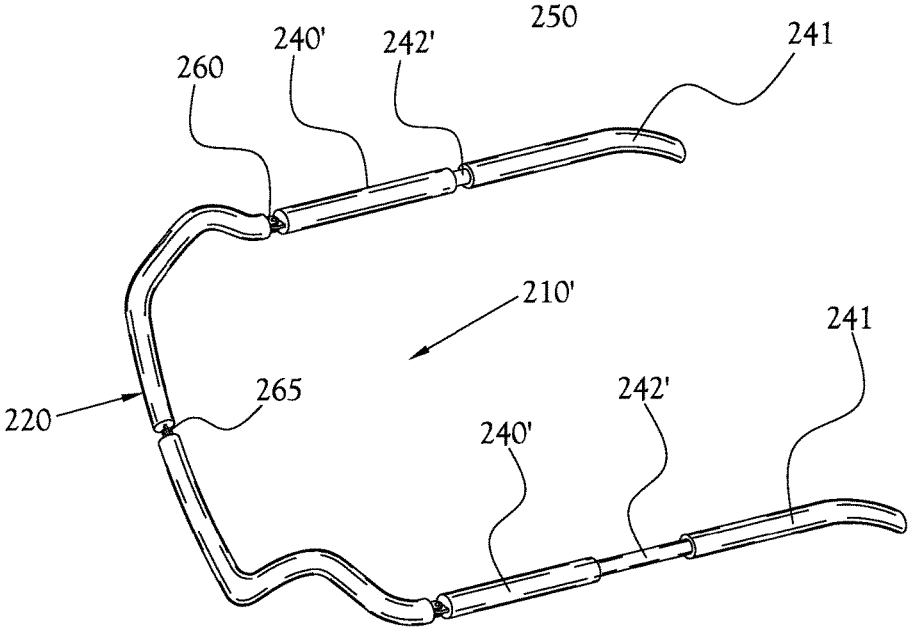
FIG. 14 is a perspective view of a further alternate embodiment of the hair lifting, retention, and styling device illustrated in FIG. 11 with telescoping side members.

It will be understood by those skilled in the art that while FIGS. 11-13 illustrate one embodiment of providing for telescoping movement of the side members 240 and telescoping members 242 and 244, there are other ways of providing telescoping movement such that the length of the side members 240 can be adjusted. In this regard, FIG. 14 illustrates an additional way of providing such telescoping adjustment. In this regard, device 210' includes side members 240' and 241, which have substantially the same cross sectional area, could each receive, and slide upon telescoping member 242' thereby allowing the wearer to adjust the size of device 210'.

It will be further recognized by those skilled in the art that in either the preferred embodiment hair lifting, retention, and styling device 10, or the other embodiments described herein, the interior surface of the portions of the cross piece member 20 and the side members 40 can be smooth or, as illustrated in FIG. 10, can have grooved portions 70 that are grooved, and the distal ends 45 of side members 40 can include serrations or teeth 80 for providing enhanced gripping of the wearer's hair without departing from the spirit and scope of the present invention.

Figure 17:
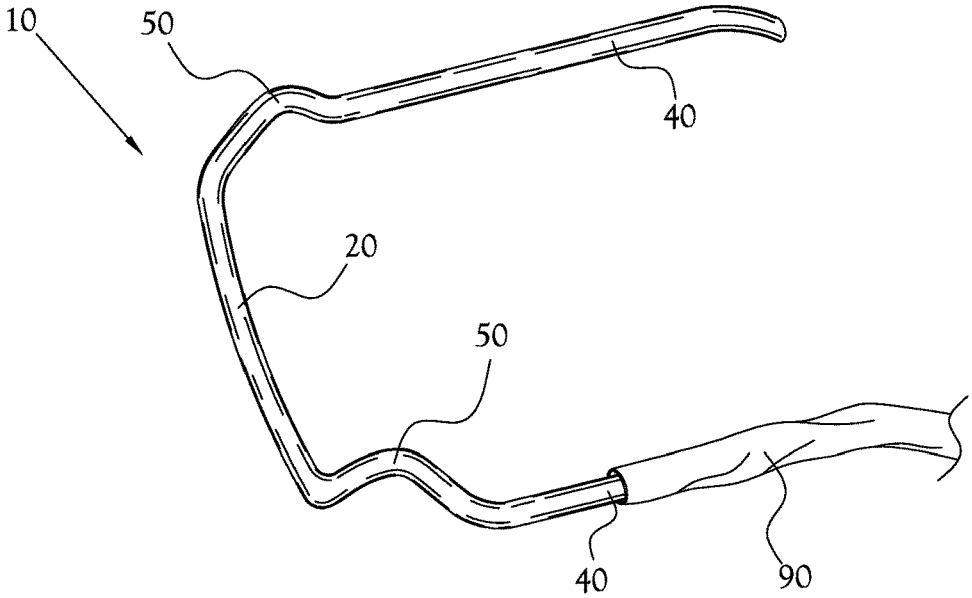
FIG. 17 is a perspective view of the device of the present invention encased in a decorative sleeve.
Figure 18:
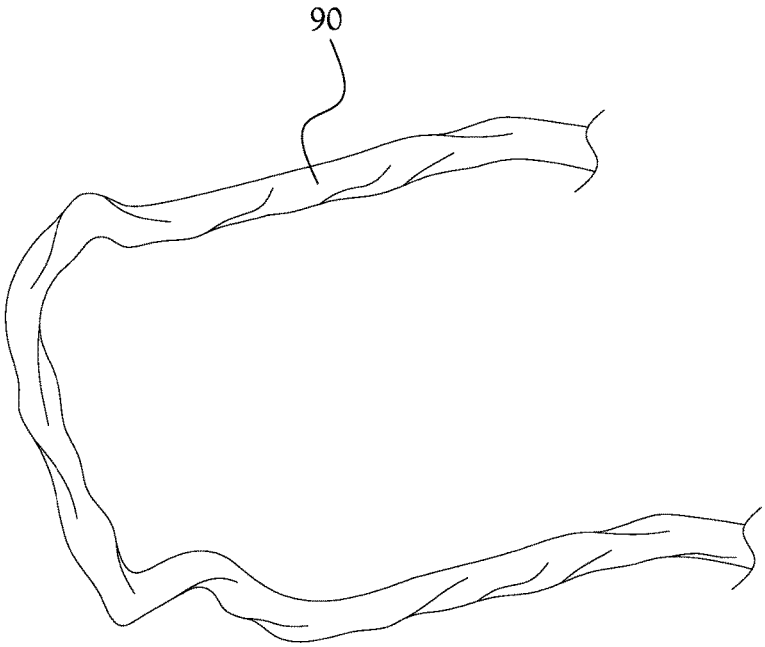
FIG. 18 is a perspective view of the device illustrated in FIG. 17.

It will be further appreciated by those skilled in the art that the preferred embodiment hair lifting, retention, and styling device 10, and the other embodiments described herein, can be constructed of a clear, translucent, or subtly colored material so as to render the device itself inconspicuous, such that attention is only drawn to the lift and volume enhancing effect produced in the wearer's hair. Alternatively, both the preferred embodiment hair lifting, retention, and styling device 10, and the alternate embodiments described herein, can be stylized or ornamented in many various ways, including but not limited to selected colors of materials, incorporation of woven threads, beading, and other forms of ornamentation as will be readily recognized by those skilled in the art. For instance, as illustrated in FIGS. 17 and 18, a decorative, or sweat absorbing sleeve 90 could be adapted to cover the length of the device. In this regard, sleeve 90 could either be defined by a substantially cylindrical tube of cloth that could be pulled over the length of the device; or sleeve 90 could be defined by a strip of cloth adapted to be spirally wrapped around the device of the present invention.

Figure 15:
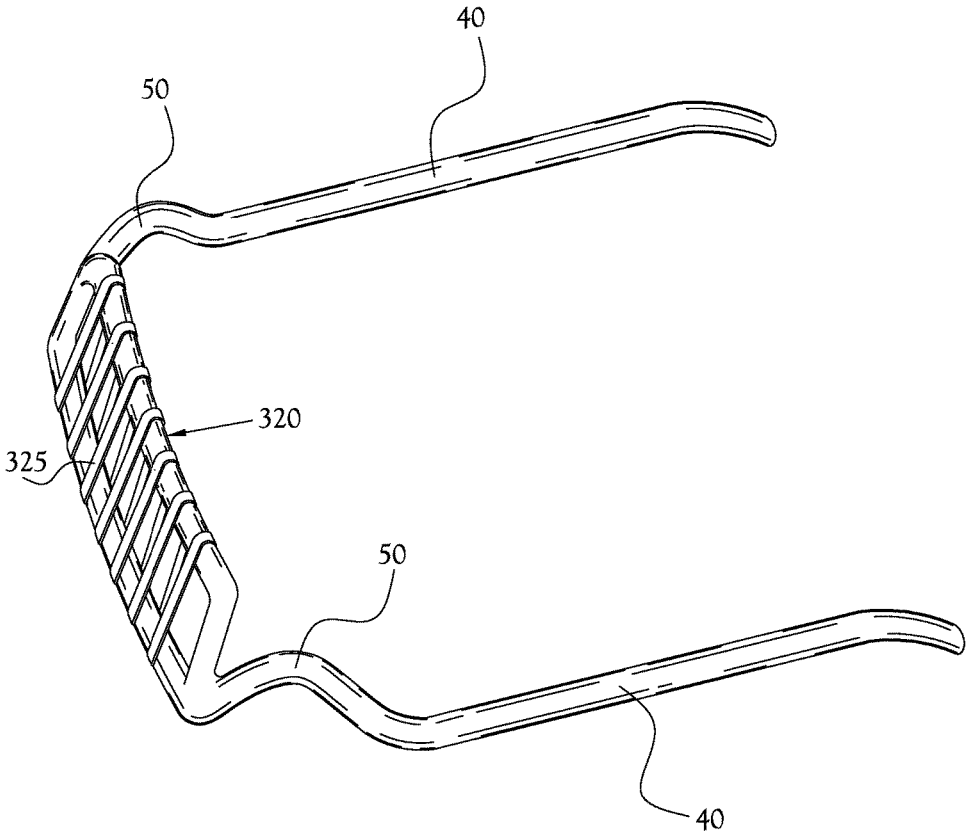
FIG. 15 is a perspective view of still a further alternate embodiment of the present invention with an expanded cross piece member.
Figure 16:
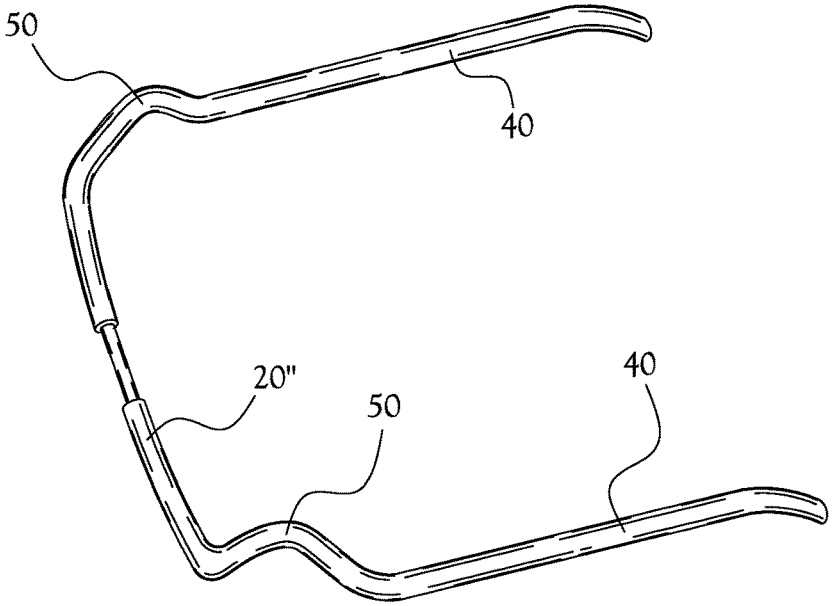
FIG. 16 is a perspective view of yet another alternate embodiment of the present invention utilizing a telescoping cross piece member.

An alternate embodiment of the rectilinear cross piece 320 is illustrated in FIG. 15. In this regard, the rectilinear cross piece 320 is expanded and has a woven or wrapped member 325 that provides a plurality of spaces across the surface of the rectilinear cross piece 320. Tufts or sections of the wearer's hair can be pulled through these spaces to provide additional styling possibilities. In FIG. 16, an additional alternate embodiment of the substantially rectilinear cross piece 20" is illustrated. In this embodiment, the cross piece member 20" is adapted to be a telescoping cross piece member that provides for adjustment of the width of the device of the present invention.

Figure 19:
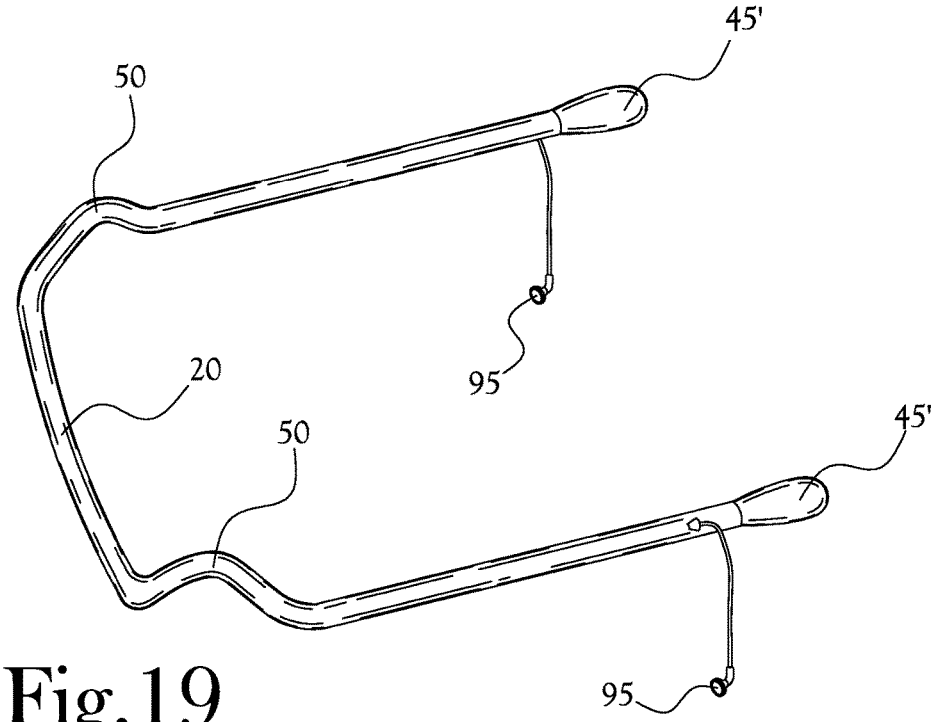
FIG. 19 is a perspective view of still yet another alternate embodiment of the present invention in which the hair lifting, retention, and styling device, in addition to providing enhanced lift and volume to a wearer's hairstyle also serves as a support for in ear, or "ear bud" style headphones.

As illustrated in FIG. 19, in addition to providing enhanced lift and volume to a wearer's hairstyle, the hair device of the present invention could serve a dual role as a support for in-ear, or "ear bud" style headphones 95. It will be appreciated by those skilled in the art that these ear bud headphones 95 could be hardwired to a device (not shown) such as a music player or a "smart" communication device or could be in wireless communication with such a communication device.

Figure 20:
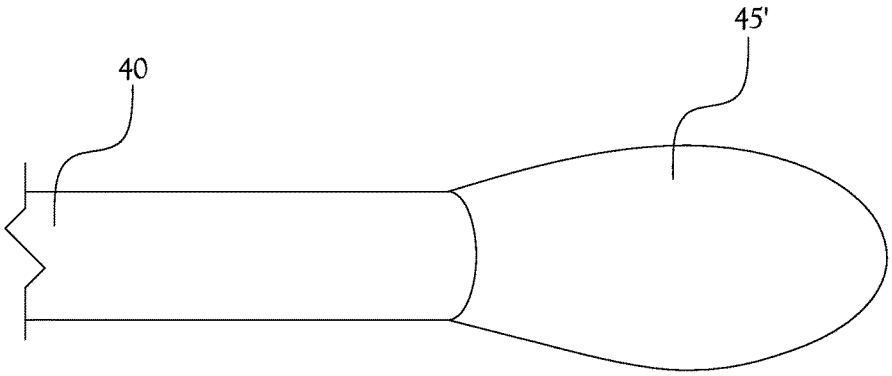
FIGS. 20 and 21 are close-up views of alternate embodiments of the distal ends of the side piece members of the device of the present invention.
Figure 21:
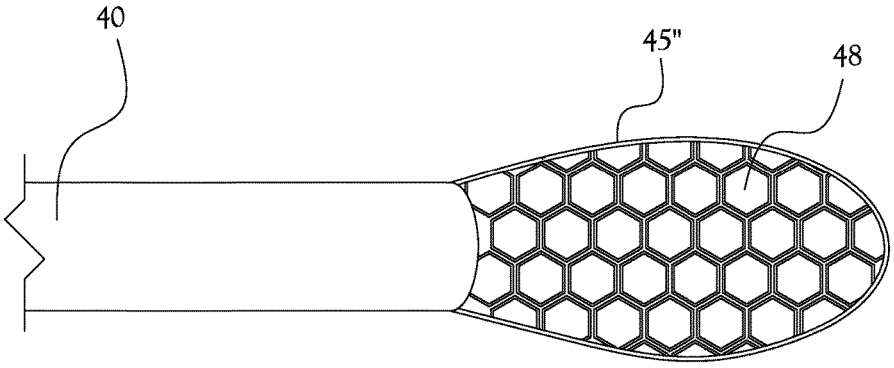
Figure 22:
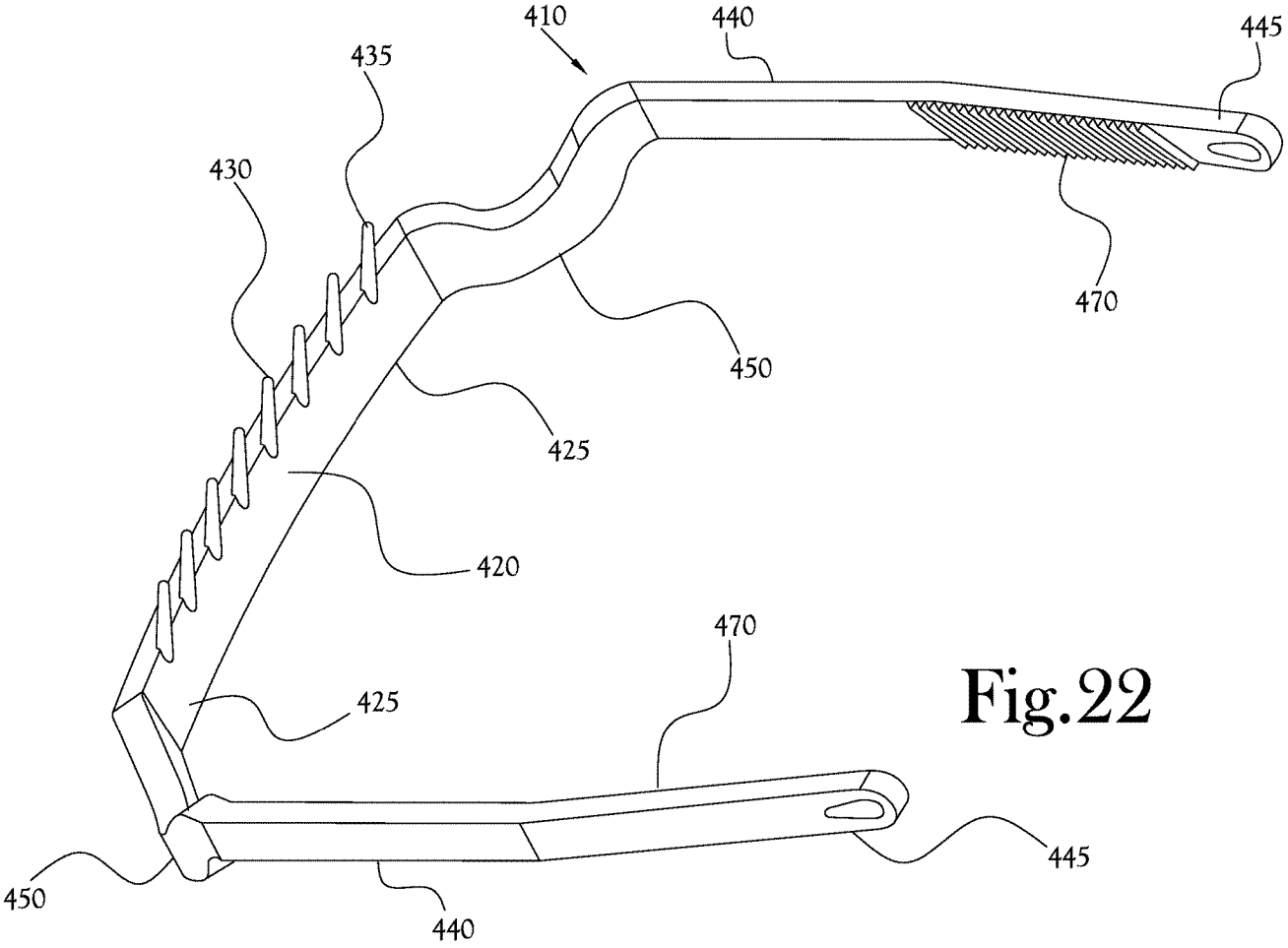
FIG. 22 is a perspective view of a further alternate embodiment of the present invention in which the hair lifting, retention, and styling device further includes teeth for providing enhanced styling and lift of the wearer's hair while in use.
Figure 23:
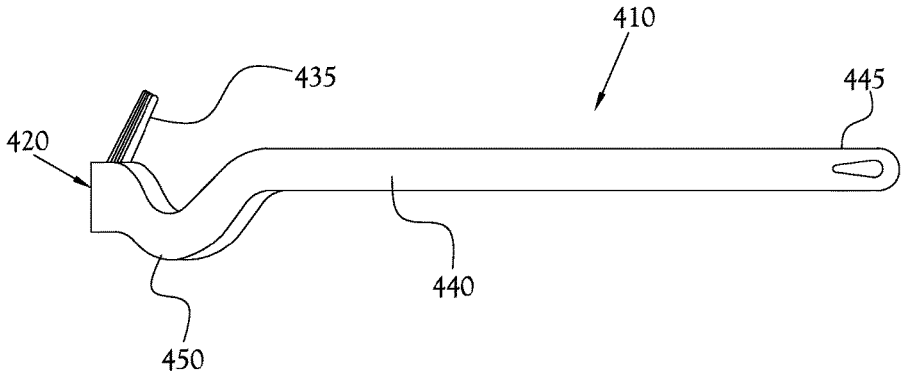
FIG. 23 is a side elevation view of the embodiment illustrated in FIG. 22.
Figure 24:
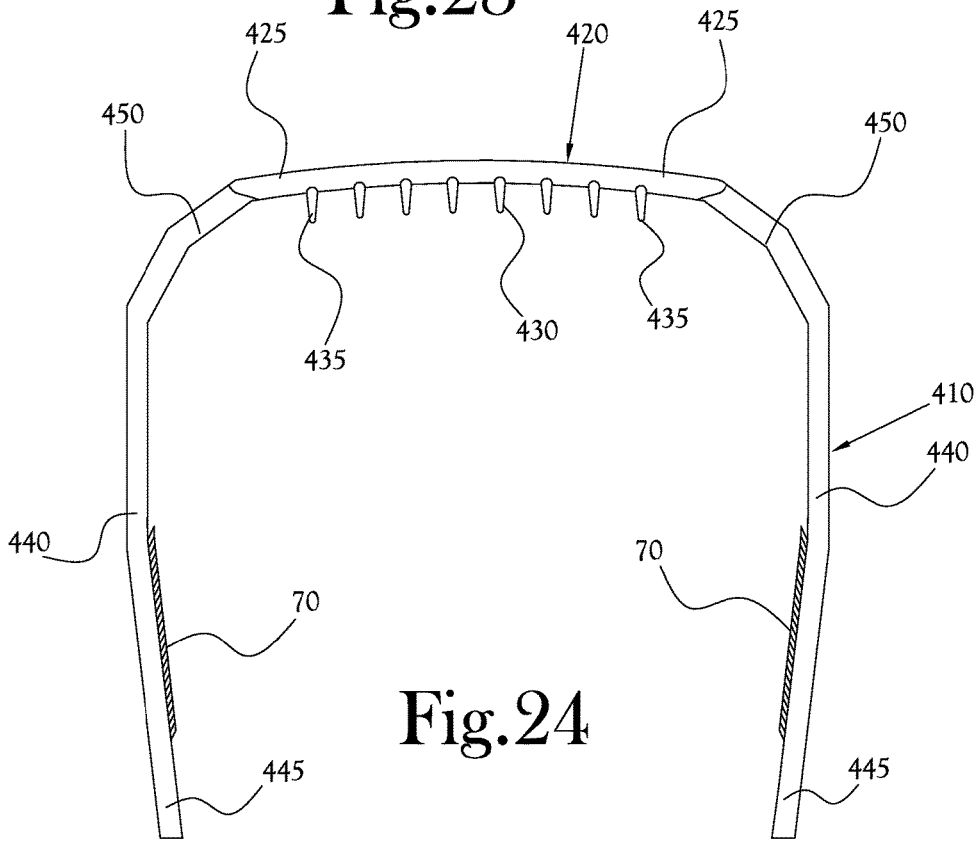
FIG. 24 is a plan view of the embodiment illustrated in FIG. 22.
Figure 25:
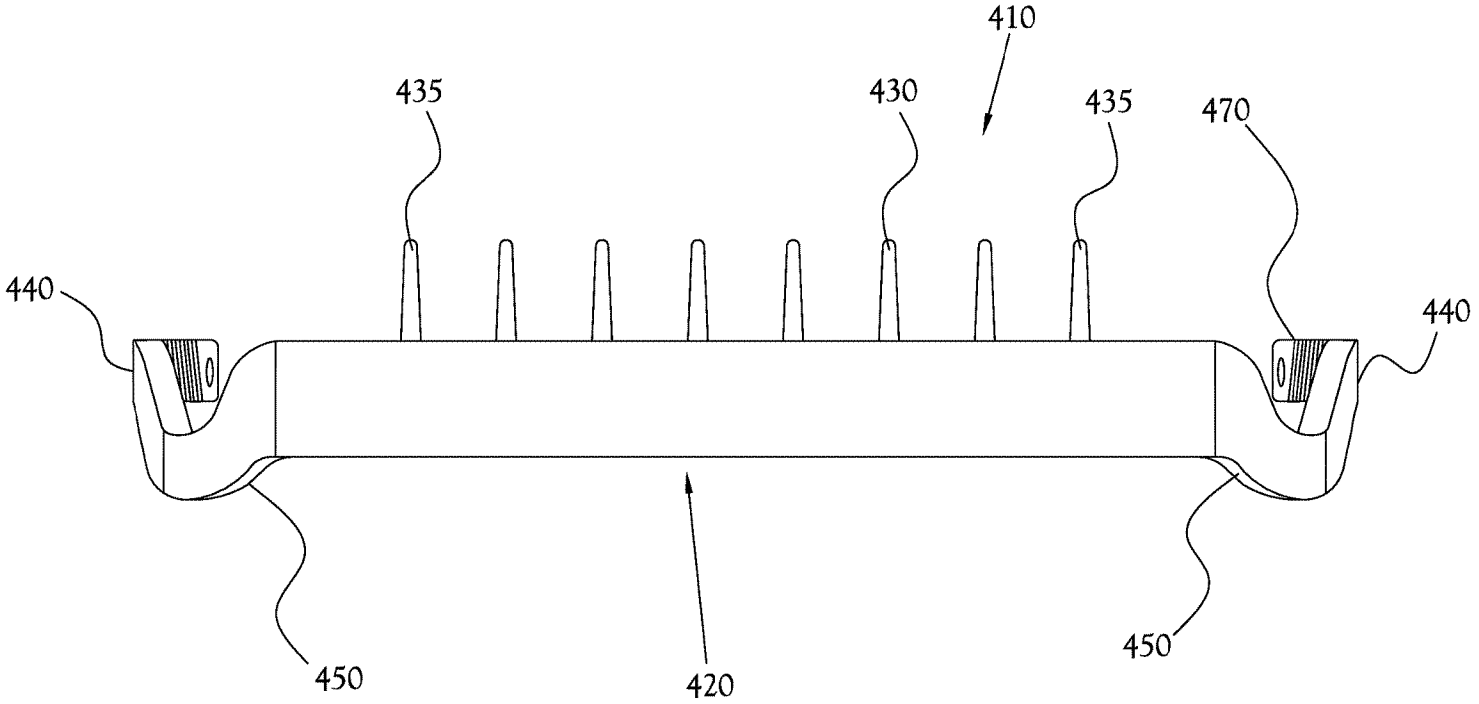
FIG. 25 is a rear elevation view of the embodiment illustrated in FIG. 22.

FIGS. 20 and 21 show close-up views of alternate embodiments of the distal ends of the side piece members 40 of the device of the present invention. In this regard, the distal ends 45' could be tear-drop shaped and smooth. Alternatively, distal ends 45" could be tear-drop shaped and provided with grip enhancing nodules 48.

Finally, in an additional alternate embodiment of the present invention, as illustrated in FIGS. 22-25, hair lifting, retention, and styling device 410 is disclosed. As discussed with the other embodiments, hair lifting, retention, and styling device 410 has an elongated, substantially rectilinear cross piece member 420 having first and second distal ends 425. The hair lifting, retention, and styling device 410 also includes elongated side members 440 carried proximate the cross piece member 420. As described above, vertically oriented curved portions defining bight members 450 are disposed between side members 440 and the distal ends 425 of rectilinear cross piece member 420. Side members 440 terminate in distal end members 445. As described above, the interior surface of the side members 440 can include grooved portions 470. Further, to provide further styling of the wearer's hair, rectilinear cross piece member 420 is provided with a plurality of projections defining teeth 430 along the length of rectilinear cross piece member 420. In an exemplary embodiment, the teeth 430 are approximately ⅞ of an inch in length with the length of the two end teeth 435 being slightly shorter so as not to dig into the wearer's scalp. In one embodiment, the teeth 430 are approximately 3 mm in diameter.

From the foregoing description, it will be recognized by those skilled in the art that a hair lifting, retention, and styling device has been provided which provides lift and enhanced volume to a wearer's hair thus augmenting and enhancing the wearer's chosen hairstyle. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A hair lifting, retention, and styling device for lifting at least a portion of a wearer's hair thereby providing enhanced volume to said wearer's hairstyle and for retaining said hair from a wearer's face, said hair lifting, retention, and styling device comprising:

a substantially rectilinear cross piece member having a first distal end and a second distal end;

a first substantially rectilinear side piece member cooperating with said first distal end of said substantially rectilinear cross piece member, said first rectilinear side piece member having a distal end;

a second substantially rectilinear side piece member cooperating with said second distal end of said substantially rectilinear cross piece member, said second rectilinear side piece member having a distal end, whereby said distal ends of said first and said second rectilinear side members engage respective sides of said wearer's head; and a first vertically oriented curved bight member disposed between said cross piece member and said first substantially rectilinear side piece member, said first vertically oriented curved bight member having a first section that curves downwardly from said substantially rectilinear cross piece member and a second section that curves upwardly towards said first substantially rectilinear side piece member, and a second vertically oriented curved bight member disposed between said substantially rectilinear cross piece member and said second substantially rectilinear side piece member, said second vertically oriented curved bight member having a first section that curves downwardly from said substantially rectilinear cross piece member and a second section that curves upwardly towards said first substantially rectilinear side piece member, whereby said cross piece member is selectively offset from said first and second substantially rectilinear side piece members.

2. The hair lifting, retention, and styling device of claim 1 wherein said substantially rectilinear cross piece member is planar.

3. The hair lifting, retention, and styling device of claim 1 wherein said cross piece member and said side piece members have a substantially rectangular cross section.

4. The hair lifting, retention, and styling device of claim 1 wherein said first and second substantially rectilinear side piece member include telescoping members adapted to extend and retract telescopically from said first and second side members, such that a length of said first and second side members inclusive of said telescoping members is adjustable thereby allowing a wearer to adjust said device for optimal fit and comfort.

5. The hair lifting, retention, and styling device of claim 1 wherein said cross piece member is adapted to be foldable about a hinge member proximate a midpoint of said cross piece member.

6. The hair lifting, retention, and styling device of claim 1 wherein said first and said second substantially rectilinear side pieces are in hinged connection with said substantially rectilinear cross piece member whereby said first and said second substantially rectilinear side piece members can be folded inwardly.

7. The hair lifting, retention, and styling device of claim 1 wherein said hair lifting, retention, and styling device further includes an accessory device.

8. The hair lifting, retention, and styling device of claim 7 wherein said accessory device is selected from a group consisting of a fabric sleeve and earbuds.

9. The hair lifting, retention, and styling device of claim 8 wherein said fabric sleeve is defined by a substantially cylindrical tube of fabric.

10. The hair lifting, retention, and styling device of claim 1 wherein said substantially rectilinear cross piece member further includes a plurality of projections defining teeth for providing additional styling of a wearer's hair.

11. A hair lifting, retention, and styling device for lifting at least a portion of a wearer's hair thereby providing enhanced volume to said wearer's hairstyle and for retaining said hair from a wearer's face, said hair lifting, retention, and styling device comprising:

a substantially rectilinear cross piece member having a first distal end and a second distal end, wherein said cross piece member is adapted to be foldable about a hinge member proximate a midpoint of said cross piece member;

a first substantially rectilinear side piece member cooperating with said first distal end of said substantially rectilinear cross piece member, said first rectilinear side piece member having a distal end;

a second substantially rectilinear side piece member cooperating with said second distal end of said substantially rectilinear cross piece member, said second rectilinear side piece member having a distal end, wherein said first and said second substantially rectilinear side pieces are in hinged connection with said substantially rectilinear cross piece member whereby said first and said second substantially rectilinear side piece members can be folded inwardly, further wherein said first and said second substantially rectilinear side pieces have at least a first telescoping member which extends and retracts telescopically from each of said first and second side members, such that a length of said side member inclusive of said telescoping member is adjustable; and a first vertically oriented curved bight member disposed between said cross piece member and said first substantially rectilinear side piece member, said vertically oriented curved bight member having a first section that curves downwardly from said substantially rectilinear cross piece member and a second section that curves upwardly towards said first substantially rectilinear side piece member, and a second vertically oriented curved bight member disposed between said cross piece member and said second substantially rectilinear side piece member, said vertically oriented curved bight member having a first section that curves downwardly from said substantially rectilinear cross piece member and a second section that curves upwardly towards said first substantially rectilinear side piece member;

whereby said distal ends of said first and said second rectilinear side members engage respective sides of said wearer's head.

12. The hair lifting, retention, and styling device of claim 11 wherein said substantially rectilinear cross piece member is planar.

13. The hair lifting, retention, and styling device of claim 11 wherein said cross piece member and said side piece members have a substantially rectangular cross section.

14. The hair lifting, retention, and styling device of claim 11 wherein said substantially rectilinear cross piece member further includes a plurality of projections defining teeth for providing additional styling of a wearer's hair.

15. A hair lifting, retention, and styling device for lifting at least a portion of a wearer's hair thereby providing enhanced volume to said wearer's hairstyle and for retaining said hair from a wearer's face, said hair lifting, retention, and styling device comprising:

a substantially rectilinear cross piece member having a first distal end and a second distal end, wherein said substantially rectilinear cross piece member is planar, wherein said substantially rectilinear cross piece member further includes a plurality of projections defining teeth for providing additional styling of a wearer's hair;

a first substantially rectilinear side piece member cooperating with said first distal end of said substantially rectilinear cross piece member, said first rectilinear side piece member having a distal end;

a second substantially rectilinear side piece member cooperating with said second distal end of said substantially rectilinear cross piece member, said second rectilinear side piece member having a distal end, wherein said cross piece member and said side piece members have a substantially rectangular cross section; and a first vertically oriented curved bight member disposed between said cross piece member and said first substantially rectilinear side piece member, said vertically oriented curved bight member having a first section that curves downwardly from said substantially rectilinear cross piece member and a second section that curves upwardly towards said first substantially rectilinear side piece member, and a second vertically oriented curved bight member disposed between said cross piece member and said second substantially rectilinear side piece member, said vertically oriented curved bight member having a first section that curves downwardly from said substantially rectilinear cross piece member and a second section that curves upwardly towards said first substantially rectilinear side piece member, whereby said substantially rectilinear cross piece member is selectively offset from said first and second substantially rectilinear side piece members;

whereby said distal ends of said first and said second rectilinear side members engage respective sides of said wearer's head.

16. The hair lifting, retention, and styling device of claim 15 wherein said first and second substantially rectilinear side piece member include telescoping members adapted to extend and retract telescopically from said first and second side members, such that a length of said first and second side members inclusive of said telescoping members is adjustable thereby allowing a wearer to adjust said device for optimal fit and comfort.

17. The hair lifting, retention, and styling device of claim 15 wherein said cross piece member is adapted to be foldable about a hinge member proximate a midpoint of said cross piece member.

18. The hair lifting, retention, and styling device of claim 15 wherein said first and said second substantially rectilinear side pieces are in hinged connection with said substantially rectilinear cross piece member whereby said first and said second substantially rectilinear side piece members can be folded inwardly.

* * * * *